United States Patent [19]

Kozima et al.

[11] 4,301,224

[45] Nov. 17, 1981

[54] ELECTROPHOTOGRAPHIC ELEMENT WITH A COMBINATION OF BINDER RESINS

[75] Inventors: Akio Kozima, Hiratsuka; Eiichi Akutsu, Ichikawa, both of Japan

[73] Assignee: Ricoh Co., Ltd., Tokyo, Japan

[21] Appl. No.: 168,215

[22] Filed: Jul. 10, 1980

[30] Foreign Application Priority Data

Jul. 13, 1979 [JP] Japan ..... 53-89071

[51] Int. Cl.[3] ..... G03G 5/05; G03G 5/06; G03G 5/14

[52] U.S. Cl. ..... 430/58; 430/96; 430/134; 430/135

[58] Field of Search ..... 430/96, 127, 134, 135, 430/58

[56] References Cited

U.S. PATENT DOCUMENTS 3,347,670 10/1967 Nelson et al. ..... 430/96
3,378,370 4/1968 Brancato ..... 430/96 X
4,026,704 5/1977 Rochlitz ..... 430/58 X

FOREIGN PATENT DOCUMENTS 932869 7/1963 United Kingdom ..... 430/96

*Primary Examiner*—Roland E. Martin, Jr.
*Attorney, Agent, or Firm*—Blanchard, Flynn, Thiel, Boutell & Tanis

[57] ABSTRACT

An electrophotographic element comprising, in successive layers; a conductive substrate, a charge generation layer and a charge transport layer, the charge generation layer being formed by the steps of; adding to a dispersion comprising a photoconductive organic pigment, a solvent and a resin being superior in mutual solubility with said solvent a resinous solution comprising said solvent and a resin being relatively inferior in mutual solubility with said solvent to the former resin; dispersing (or stirring) the resulting mixture again, thereby obtaining a photoconductive organic pigment-dispersed resinous solution; and applying said resinous solution onto the conductive substrate and drying.

11 Claims, 2 Drawing Figures

ELECTROPHOTOGRAPHIC ELEMENT WITH A COMBINATION OF BINDER RESINS

BACKGROUND OF THE INVENTION (a) Field of the Invention

This invention relates in general to an electrophotographic element, and in particular to a multilayered electrophotographic element comprising a conductive substrate, a charge generation layer and a charge transport layer adjacent the charge generation layer.

(b) Description of the Prior Art

A plurality of multilayered electrophotographic elements comprising, in successive layers; a conductive substrate, the so-called charge generation layer (CGL) capable of generating a charge (which is called a carrier, too) by light absorption and the so-called charge transport layer (CTL) capable of transporting a charge generated by CGL by virtue of the force of an electric field, wherein the positional relation between the CGL layer and the CTL layer may be reversed and both said layers are each designed to achieve its own separate function, have hitherto been proposed and some of them are already put to practical use.

It is generally considered that a charge generation layer must be formed uniformly, extremely thin and smoothly in order to improve the electrophotographic characteristics such as electrostatic characteristics, image characteristics and so forth in the above mentioned multilayered electrophotographic elements.

The following are well known as the processes for the formation of a charge generation layer, for instance, such as (1) evaporating deposition of a charge generation material such as Se, selenium alloy, organic pigment or the like (Japanese Laid-open Patent Application No. 47838/1973, Japanese Laid-open Patent Application No. 48334/1974, etc.), (2) coating and drying of a dispersion obtained by dispersing a charge generation material such as Se, selenium alloy, inorganic pigment, organic pigment or the like in a binder (Japanese Laid-open Patent Application No. 18543/1972, etc.), (3) coating of a solution obtained by dissolving a charge generation material such as organic pigment in an organic amine (Japanese Laid-Open Patent Application No. 55643/1977, etc.) and so forth.

The aforesaid process (1) can surely form a uniform, extremely thin layer but it is defective in that it leads to the high cost of equipment and encounters difficulties in production control. Further, the evaporation depositable charge generation materials to be used therefor are limited in selection and so forth. The aforesaid process (2) is surely easy to perform as well as being advantageous in the cost aspect because the various dispersing and coating techniques have already been established, but the dispersibility and dispersion stability of the dispersion per se are called into question in order to obtain an extremely thin layer in a stable manner. The aforesaid process (3) is also easy to perform for the same reason as mentioned with reference to the above process (2), but it still involves troubles in the safety and stability of the solution per se, and further it is defective in that said process leads to high cost and high equipment cost.

SUMMARY OF THE INVENTION

It is a general object of this invention to provide an electrophotographic element wherein a charge generation layer is formed by the use of a photoconductive organic pigment-dispersed resinous solution which is prepared by dispersing therein a photoconductive organic pigment (charge generation material) being exceedingly superior in the dispersibility and dispersion stability in spite of utilizing the aforesaid process (2).

It is a further object of this invention to provide a multilayered electrophotographic element which is of a high sensitivity and scarcely shows fatigue.

We have carried out various studies and investigations about how to disperse and consequently discovered that a charge generation material-dispersed solution superior in dispersibility and dispersion stability can be obtained by using plural resins (binders) in combination and making full use of the mutual solubility between solvent and resin and that by coating this solution and drying, in spite of said solution being of the pigment dispersion type, there can be formed a uniform, extremely thin and smooth charge generation layer. This invention has been completed on the basis of the above mentioned discovery.

The characteristic of this invention consists in an electrophotographic element comprising, in successive layers; a conductive substrate, a charge generation layer and a charge transport layer, the charge generation layer being formed by the steps of; adding to (1) a dispersion comprising a photoconductive organic pigment, a solvent and a first resin (binder) which is superior in mutual solubility with said solvent (2) a resinous solution comprising said solvent and a second resin (binder) which is relatively inferior in mutual solubility with said solvent compared first to the resin; dispersing (or stirring) the resulting mixture again, thereby obtaining a photoconductive organic pigment-dispersed resinous solution; and applying said resinous solution onto the conductive substrate and drying.

DETAILED DESCRIPTION OF THE INVENTION

As is evident from the aforegoing, the indispensable condition for the preparation of the multilayered electrophotographic element according to this invention capable of achieving the above mentioned objects is to obtain a resinous solution dispersed therein a photoconductive organic pigment in a suitable manner as a charge generation layer-forming solution.

The matter calling for prior settlement for achieving this requirement is to find a solvent (solvent S) having an affinity to the charge generation material (namely, photoconductive organic pigment). The said solvent S to be suitably used in this invention is selected, for instance, by dispersing the charge generation material in various kinds of solvents in a suitable way and selecting a suitable solvent S from among them through the tests ot particle diameter, precipitation and so forth.

The matter to be settled next is to find a first resin (resin $R_1$) which exhibits a good solubility to the thus selected solvent (or solvents). The charge generation material is mixed into a first resinous solution comprising the thus selected solvent S and resin $R_1$ and is well dispersed therein in a suitable way such as mingling or the like and is pulverized into a particle diameter answering the purpose (first dispersion).

Separately, a second resin (resin $R_2$) which is inferior in solubility with the solvent S, compared to the resin $R_1$, is selected to prepare a second solution comprising said solvent S and resin $R_2$.

Thereafter, the first dispersion containing dispersed therein the charge generation material (the dispersion comprising charge generation material, resin $R_1$ and solvent S) is mixed with the second resinous solution (the solution comprising resin $R_2$ and solvent S) and the resulting mixture is dispersed or stirred again to form a second dispersion. The thus obtained second dispersion (which comprises the charge generation material, resin $R_1$, resin $R_2$ and solvent S) holds the charge generation material in the fine particle diameter state produced in the first dispersion, and still maintains the re-aggregation-free stable state. This photoconductive organic dispersion, in spite of its being of the dispersion type, when coated, makes it possible to form a uniform, extremely thin and smooth charge generation layer. In other words, a charge generation layer which is rich in the aforesaid desirable characteristics can not be formed until there is obtained a resin solution containing dispersed therein a photoconductive organic pigment stably in an extremely fine particle state.

In these drawings, 1 denotes pigment particles, 2 denotes resin $R_1$(a resin exhibiting a superior solubility in the solvent), 3 denotes the solvent, and 4 denotes resin $R_2$ (a resin being inferior in solubility in the solvent, relative to resin $R_1$).

The particulars of the reasons why such an excellent photoconductive organic pigment dispersion is obtained are not always elucidated, but we consider some to be as follows. That is, the first resin $R_1$ dissolved in a superior solvent is said to take an extended shape therein and, in general, to have a reduced viscosity. When a pigment (charge generation material) is dispersed in that solution first (resinous solution) containing said first resin dissolved therein, the permeability of the first resin solution to the pigment is promoted, whereby the pigment can be easily pulverized into fine primary particles. And, the first resin $R_1$extends to the pigment particles and is thinly adsorbed thereon. This state is illustrated in FIG. 1, wherein 1 denotes a pigment particle, 2 denotes a high molecular substance (resin $R_1$), 3 denotes a solvent, and 5 denotes a container accommodating them.

Figure 1:
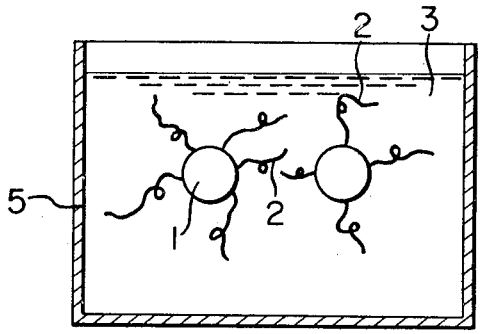
FIG. 1 is a view illustrating a state wherein pigment particles are dispersed in a solvent having a first resin dissolved therein, said first resin being one having a superior solubility in said solvent.

If left to stand as shown in FIG. 1, however, the adsorbed resin 2, while holding its extended shape, on the pigment particle 1, will mutually crosslink and coagulate with the passing of time, which leads to the formation of a huge particle.

Figure 2:
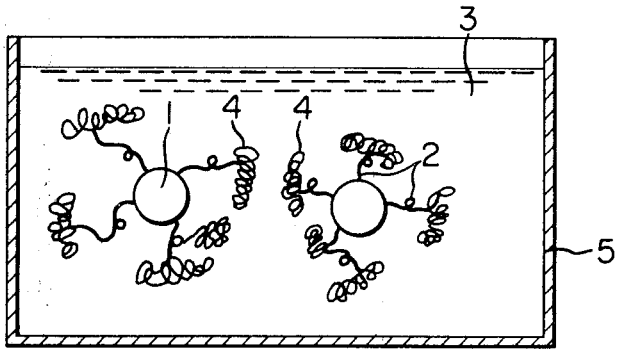
FIG. 2 is a view illustrating a state wherein the pigment particles are dispersed in a solvent and two resins are dissolved therein, one of said resins having a superior solubility in the solvent, the other resin having a relatively inferior solubility therein.

In contrast, the second high molecular substance 4 (resin $R_2$) dissolved in the solvent (solvent S) should be regarded as one dissolved in a relatively inferior solvent and therefore the resin $R_2$ is present therein taking a rounded shape. It may be considered that when the second resinous solution (resin $R_2$- solvent S), under such a condition, is added to the pigment dispersion shown in FIG. 1 and is dispersed or stirred therein, the resin $R_2$ while holding a rounded shape because of its inferior solubility, enters between the chains of resins $R_1$ which are adsorbed onto the pigment particle 1 and are superior in solubility, and thus the two high molecular substances (resin $R_1$ and resin $R_2$) mutually adsorb and form a thick adsorption layer around the pigment particle, thereby exerting a space repelling action to each other for preventing their coagulation. This state is illustrated in FIG. 2, wherein 4 denotes resin $R_2$.

In the preparation of the electrophotographic element according to this invention, there is employed a resinous solution containing dispersed therein a photoconductive organic pigment, said solution being exceedingly superior in dispersibility and dispersion stability. This is supported by the fact that when this dispersion, is observed through a transmission type electron microscope, it is found that each pigment particle is very fine (its average particle diameter is about 0.05 to 0.1 $\mu$m) and uniform and there is no trace of aggregation. On the other hand, when a pigment is dispersed in a resinous solution comprising a resin which is superior in solubility (resin $R_1$) alone, the viscosity of the resulting dispersion increases with the passing of time, and when this dispersion is observed through a transmission type electron microscope there can be found large aggregates of pigment particles having a particle diameter of about 1 to 20 $\mu$m. And, when a pigment is dispersed in a resinous solution comprising a resin which is inferior in solubility (resin $R_2$) alone, the resulting dispersion deteriorates in dispersion stability. When this dispersion is observed through a transmission type electron microscope there can be found that the pigment particles per se are not pulverized finely and resin $R_2$ is not adsorbed onto the pigment particles.

Further, it is recognized that the charge generation layer, formed by coating a photoconductive organic pigment dispersion comprising the resin $R_1$ and resin $R_2$ in combination, has a uniform layer thickness and is lustrous. When the surface and section of this layer is observed through an electron microscope, it is found that said layer is filled with pigment particles uniformly as well as intimately. In contrast, it is recognized that the charge generation layer formed by the individual use of resin ($R_1$) which is superior in solubility or resin ($R_2$) which is inferior in solubility has a rough surface and is lusterless. When this layer is likewise observed through an electron microscope there can be found a number of aggregates of pigment particles and coating deficiencies on the surface and the section thereof is found to abound in unevenness.

It is also considered from those observation results that the dispersion according to this invention (photoconductive organic pigment - resin $R_1$ - resin $R_2$ - solvent S) has achieved the improvements in dispersibility and dispersion stability because the resin which is superior in solubility (resin $R_1$) has been adsorbed onto the circumference of the pigment particles and the resin which is inferior in solubility (resin $R_2$) has been adsorbed further onto the circumference of the same.

As will be seen from the foregoing, this invention achieves the formation of the charge generation layer by using two kinds of resins (binders) in combination, said resins (binders) having somewhat different solubilities in a certain solvent, respectively, and by dispersing the photoconductive organic pigment in the resulting resin solution.

It is generally said that when the "solubility parameter" of a solvent is close to that of a resin, said solvent and resin are superior in solubility, the term "solubility parameter" being used as a value indicating the solubility relation between a solvent and a resin. The solubility parameter is defined as a square root of a cohesive energy density of a given product (solvent, resin or the like).

$$\delta=\sqrt{\Delta E/V}$$

(wherein, $\Delta E$ is energy of vaporization and V is molar volume)

As the actual measures for obtaining the solubility parameter there can be enumerated those of (1) using the above formula, (2) calculating from the chemical constitution of a given product, (3) comparing the solubility power of a product having an unknown solubility parameter value with that of a product having a known solubility parameter value and so forth. In fact, however, the solubility parameters of various products can be determined from many documents without relying on the above mentioned measures.

As is evident from the explanations made up to now, this invention employs said solubility parameter as a standard for selecting resins (binders) to be used therein. The results obtained from a series of investigations have taught that the combination of solvent S and a resin (resin $R_1$) having a superior solubility in said solvent should be effected between those whose difference in solubility parameter is within the range of about 1.0, preferably 0.8, and the difference in solubility parameter between resin $R_1$ and a resin (resin $R_2$) whose solubility with solvent S is relatively inferior to that of resin $R_1$ should be in the range of from 0.2 to 2.2, preferably from 0.09 to 2.2.

In this connection, Table-1 shows solubility parameters of typical solvents, and Table-2shows solubility parameters of typical resins. In this connection, it is to be noted that the solubility parameters are shown in the unit of $(cal/cc)^{\frac{1}{2}}$, and the bracketed numerals of copolymers in Table-2 show molar ratios.

TABLE 1

| | |
|---|---|
| cyclohexane | 8.2 |
| isobutylacetate | 8.3 |
| methylisobutylketone | 8.4 |
| isopropyl acetate | 8.4 |
| propyl butyrate | 8.4 |
| (n)butyl acetate | 8.5 |
| methyl isopropyl ketone | 8.5 |
| carbon tetrachloride | 8.6 |
| cyclopentane | 8.7 |
| ethylene glycol monoethyl ether acetate | 8.7 |
| methyl propyl ketone | 8.7 |
| xylene | 8.8 |
| toluene | 8.9 |
| ethyl acetate | 9.1 |
| benzene | 9.2 |
| tetrahydrofuran | 9.2 |
| ethylene glycol methyl ethyl acetate | 9.2 |
| trichloroethylene | 9.2 |
| methyl ethyl ketone | 9.3 |
| tetrachloro ethylene | 9.3 |
| monochlorobenzene | 9.5 |
| ethylene glycol monobutyl ether | 9.5 |
| methyl acetate | 9.6 |
| 1,1,2-trichloroethane | 9.6 |
| methylene chloride | 9.7 |
| ethylene dichloride | 9.8 |
| acetone | 9.9 |
| dioxane-1,4 | 10.0 |
| isobutyl alcohol | 10.5 |
| ethylene glycol monoethyl ether | 10.5 |
| amyl alcohol | 10.9 |
| n-butyl alcohol | 11.4 |
| isopropyl alcohol | 11.5 |
| n-propyl alcohol | 11.9 |
| N,N-dimethyl formamide | 12.1 |

TABLE 1-continued

| | |
|---|---|
| furfuryl alcohol | 12.5 |
| ethyl alcohol | 12.7 |
| nitromethane | 12.7 |
| methyl alcohol | 14.5 |
| ethylene glycol | 14.6 |

TABLE 2

| | |
|---|---|
| polymethyl acrylate | 9.8–10.4 |
| polyethyl acrylate | 9.2–9.7 |
| polybutyl acrylate | 8.5–9.1 |
| polypropyl acrylate | 9.0–9.05 |
| polyacrylonitrile | 12.5–15.4 |
| butadiene~acrylonitrile copolymer | |
| (82/18) | 8.75–8.66 |
| (80/20) | 9.0–9.5 |
| (75/25) | 9.25–9.5 |
| (70/30) | 9.90–9.83 |
| (61/39) | 10.45–10.40 |
| butadiene~styrene copolymer | |
| (96/4) | 8.13–8.04 |
| (90/10) | 8.37 |
| (97.5/12.5) | 8.10–8.01 |
| (85/15) | 8.4–8.5 |
| (75/25) | 8.4–8.6 |
| (60/40) | 8.5–8.7 |
| silicone resin (dimethyl siloxane) | 7.3 |
| epoxy resin | 10.9 |
| ethyl cellulose | 10.3 |
| polyethylene terephthalate | 10.7 |
| polymethyl methacrylate | 9.25–9.50 |
| polystyrene | 9.1 |
| polyurethane | 10.0 |
| polyvinyl acetate | 9.4 |
| polyvinyl alcohol | 12.6 |
| polyvinyl chloride | 9.3–9.5 |
| polyvinylidene chloride | 12.2 |
| vinyl chloride~vinyl acetate copolymer (87/13) | 10.6 |
| nitrocellulose | 10.7–11.4 |
| cellulose acetate | 10.7–11.5 |
| polycarbonate | 9.5 |
| polyvinyl butyral resin | 8.9–10.8 |
| melamine resin | 9.6–10.1 |

From among the solvents recited in the above Table -1 there can be enumerated the following SC as preferable solvents, the following SB as more preferable solvents and the following SA as most preferable solvents:

(SA) Solvents having a solubility parameter ranging from 9.1 to 9.3, including, as typical ones, tetrahydrofuran, methyl ethyl ketone and ethyl acetate;

(SB) Solvents having a solubility parameter ranging from 8.6 to 9.0 or from 9.4 to 10.5, including as typical ones, toluene, xylene, monochlorobenzene, ethylene glycol monobutyl ether, ethylene dichloride, ethylene glycol monoethyl ether and dioxane-1,4; and (SC) Solvents having a solubility parameter ranging from 8.2 to 8.5 or from 10.6 to 12.7, including, as typical ones, n(butyl)acetate, cyclohexane and isopropyl alcohol.

And, from among the resins recited in the above Table-2 there can be enumerated the following RC as preferable combinations of resins (combinations of resin $R_1$ and resin $R_2$), the following RB as more preferable combinations of resins and the following RA as most preferable combinations of resins:

(RA) Combination of polyvinyl buytral or methyl cellulose with resins (for instance, polymethyl acrylate, cellulose acetate and polycarbonate) having the difference in solubility parameter ranging from 0.9 to 2.2 as against the former;

(RB) Combinations of polyethylene terephthalate, polystyrene or polyurethane with resins (for instance, polyvinylidene chloride, cellulose acetate and nitrocellulose) having the difference in solubility parameter ranging from 0.9 to 2.2 as against the former; and (RC) Combinations of polyvinyl chloride, butadiene-acrylonitrile copolymer or acrylic resin with resins (for instance, polyvinylidene chloride and polyacrylonitrile) having the difference in solubility parameter ranging from 0.9 to 2.2 as against the former.

Photoconductive organic pigments suitably used in this invention include for instance CI Pigment Blue-25 (CI 21180), CI Pigment Red 41 (CI 21200), CI Acid Red 52 (CI 45100), CI Basic Red 3 (CI 45210), and further the azo pigment having a carbazole skeleton (Japanese Laid-open Patent Application No. 95033/1978), the azo pigment having a styryl stilbene skeleton (Japanese Laid-open Patent Application No. 133229/1978), the azo pigment having a triphenylamine skeleton (Japanese Laid-open Patent Applicaton No. 132547/1978), the azo pigment having a dibenzothiophene skeleton (Japanese Laid-open Patent Application No. 21728/1979), the azo pigment having an oxadiazole skeleton (Japanese Laid-open Patent Applicaton No. 12742/1979), the azo pigment having a fluorenone skeleton (Japanese Laid-open Patent Application No. 22834/1979), the azo pigment having a bisstilbene skeleton (Japanese Laid-open Patent Application No. 17733/1979), the azo pigment having a distyryloxadiazole skeleton (Japanese Laid-open Patent Application No. 2129/1979), the azo pigment having a distyrylcarbazole skeleton (Japanese Laid-open Patent Application No. 17724/1976) and so forth. Still further, there can be effectively used phthalocyanine type pigments such as CI Pigment Blue 16 (CI 74100), etc.; indigo type pigments such as CI Bat Brown 5 (CI 73410), CI Bat Dye (CI 73030), etc.; perylene type pigments such as Argoscarlet B (available from Bayer Company), Indanthrene Scarlet R (available from Bayer Company) and so forth.

The electrophotographic element may actually be prepared by applying said charge generation layer-forming solution onto a conductive substrate by means of doctor blade, wire bar or the like, said substrate comprising a metallic or metal oxide-made plate, cylinder or the like, a metal or metal oxide-evaporated or sputtered plastic film, fabric, paper or the like, and dried to form a charge generation layer having a thickness of from about 0.05 to about 20 μm, preferably from 0.1 to 2 μm, and further forming thereon in the usual manner a charge transport layer having a thickness of from about 5 to about 100 μm, preferably from 5 to 20 μm.

The resin (binder) content in the charge generation layer suitably is in the range of from 0.1 to 2 parts by weight based on part by weight of the photoconductive organic pigment, preferably in the range of from 0.25 to 1 part by weight. And, the weight ratio of the resin $R_1$ exhibiting a superior solubility in a solvent to the resin $R_2$ exhibiting a relatively inferior solubility in a solvent is in the range of from 0.1:1 to 1:0.1. In case where said ratio is less than 0.1:1 the dispersion stability of the charge generation layer-forming solution deteriorates, while in case where said ratio is over 1:0.1 the pigment particles are apt to aggregate, thereby hampering the stable formation of the uniform charge generation layer. A suitable quantity of sensitizer or plasticizer may be added to the charge generation layer as occasion demands.

On the other hand, the materials used for the charge transport layer may be those used for convertional multilayered electrophotographic elements. That is, as the materials suitably used for the charge transport layer there can be enumerated electron donators such as poly-N-vinyl carbazole and its derivatives, poly-γ-carbazolyl ethyl glutamate and its derivatives, pyrene-formaldehyde condensate and its derivatives, polyvinyl pyrene, polyvinyl phenanthrene, oxazole derivatives, oxadiazole derivatives, imidazole derivatives, 9-(p-diethylaminostyryl) anthracene, 1,1-bis(4-dibenzylaminophenyl) propane, styrylanthracene, styrylpyrazoline, phenylhydrazones and the like or electron acceptors such as fluorenone derivatives, dibenzothiophene derivatives, indenothiophene derivatives, phenanthrenequinone derivatives, indenopyridine derivatives, thioxanthone derivatives, benzo[c] cinnoline derivatives, phenozine oxide derivatives, tetracyanoethylene, tetracyanoquinodimethane, bromanil, chloranil, benzoquinone and the like. These materials, if needed, may be dissolved in a suitable solvent in conjunction with sensitizer, binder and/or plasticizer and thereafter coated onto the charge generation layer.

In the electrophotographic element according to this invention, furthermore, prior to the formation of the charge generation layer, an adhesive layer of polyamide, polyvinyl acetate, polyurethane or the like or a thin layer of aluminum oxide or the like may be formed on the conductive substrate by means of the usual method such as coating, evaporation or the like so as to have a thickness of from about 0.01 to about 1.0 μm in order that the characteristics such as chargeability and adhesive property between the photosensitive layer and the conductive substrate may be thereby improved.

And, the explanation was made heretofore taking the case of a multilayered electrophotographic element comprising, in successive layers, a conductive substrate, a charge generation layer and a charge transport layer. In this connection, however, it is to be understood that a multilayered electrographic element in which the above positional relation was inverted between the charge generation layer and the charge transport layer, that is, a multilayered electrophotographic element comprising, in successive layers, a conductive substrate, a charge transport layer and a charge generation layer is also serviceable as the element as intended by this invention.

As described above, two kinds of resins having specified relations with the binder contained in the charge generation layer are utilized in the electrophotographic element according to this invention so that the photoconductive organic pigment dispersed in this binder is allowed to have a uniform distribution. The use of the electrophotographic element according to this invention, accordingly, permits to obtain a very satisfactory copied image. In this connecton, it goes without saying that although this invention is described relating to multilayered electrophotographic elements, if conventional mixed type elements employ pigments (photoconductors), resins and solvents therein, such an inventive idea may be incorporated in the electrophotographic element according to this invention.

DESCRIPTION OF THE PREFERRED EMBODIMENTS

EXAMPLE 1

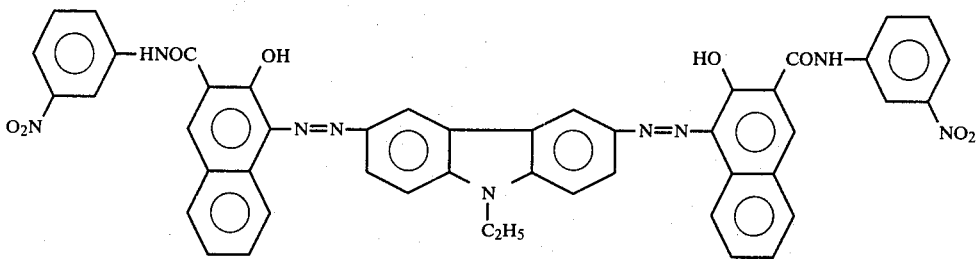

Two grams of azo pigment (photoconductive organic pigment) having a carbazole skeleton represented by the above mentioned structural formula were placed in a ball mill in conjunction with 14 g of tetrahydrofuran which is a solvent having a superior affinity to this azo pigment and 6 g of 5 wt. % tetrahydrofuran solution of a polyvinyl butyral resin (Denka Butyral #3000-2, available from Denki Kagaku Kogyo K.K.) which is capable of exhibiting a superior solubility against said tetrahydrofuran and the resulting mixture was fully milled therein. To the same were mixed 14 g of 5 wt. % tetrahydrofuran solution of a polyurethane resin (Paraprence pellet 27SM, available from Nihon Polyurethane Kogyo K.K.) which is inferior in the solubility against the tetrahydrofuran to said polyvinyl butyral resin and 2 g of tetrahydrofuran and the resulting mixture was milled again.

Subsequently, this mill base was taken out thereof and placed in a container and tetrahydrofuran was added dropwise thereto with stirring to thereby dilute till the solid content concentration in said base reached 1.6 wt. %. The thus prepared photoconductive organic pigment dispersion was observed to have an extremely superior dispersion stability and when put in a sedimentation tube for measuring the degree of sedimentation, it was observed that no sedimentation took place even after the lapse of one week. And, when it was filtered by means of a stainless steel-made filter whose effective diameter is 1 μm, there was found no clogging, whereby the whole quantity of said dispersion was allowed to pass through the filter.

This photoconductive organic pigment dispersion was coated onto the surface of an aluminum-evaporated polyester film by means of a doctor blade and the same was dried at 80° C. for 1 minute to thereby form a charge generation layer having a thickness of about 0.5 μm. Subsequently, a solution having the following composition was coated onto the surface of the resulting charge generation layer by means of a doctor blade and the same was dried at 100° C. for 30 minutes to thereby form a charge transport layer having a thickness of about 15 μm. Thus, a multilayered electrophotographic element was prepared.

| | |
|---|---|
| 9-(p-diethylaminostyryl)anthracene | 4 g |

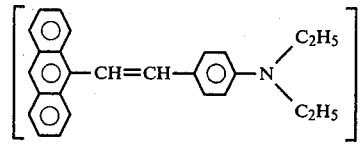

| | |
|---|---|
| polycarbonate resin (Panlite K-1300, available from TEIJIN K.K.) | 5 g |
| 1,2-dichloroethane | 41 g |

This element was subjected to -6KV corona discharge for 20 seconds by means of an electrostatic copying paper tester and thus charged. Thereafter, the thus charged element was left standing in the dark for 20 seconds for measuring the surface potential Vpo at that time, and then was exposed to light from a tungsten lamp for 30 seconds so that the surface intensity on the surface of the element became 20 lux. The decay of the surface potential at that time and the time required therefor were recorded by means of a recorder to thereby measure the quantity of exposure E1/10 (lux.-sec) required until the Vpo was reduced to one-tenth and the surface potential Vp30 after 30 seconds' exposure. This operation and measurement were repeated ten times. The results thus obtained are as shown in Table-3.

TABLE 3

| | The first time | The tenth time |
|---|---|---|
| Vpo (volt) | 1120 | 1090 |
| E1/10 (lux.sec) | 4.6 | 4.4 |
| Vp30 (volt) | 0 | 0 |

EXAMPLE 2

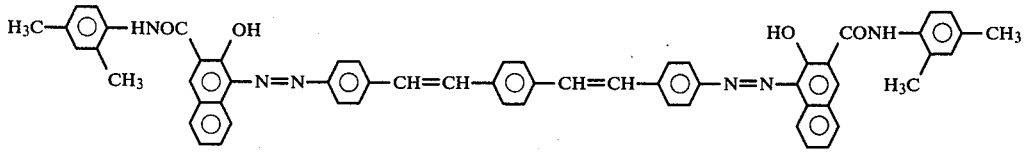

Two grams of azo pigment (photoconductive organic pigment) having a stilbene skeleton represented by the above mentioned structural formula were placed in a ball mill in conjunction with 14 g of tetrahydrofuran which is a solvent having a superior affinity to this azo pigment and 6 g of 5 wt. % tetrahydrofuran solution of a polyvinyl butyral resin (S-lec BLS, available from Sekisui Kagaku Kogyo K.K.) which is capable of exhibiting a superior solubility against said tetrahydrofuran and the resulting mixture was fully milled therein. To the same were mixed 14 g of 5 wt. % tetrahydrofuran solution of a methyl methacryl resin (Elvacite 2010, available from du Pont) which is inferior in the solubility against the tetrahydrofuran to said polyvinyl butyral resin and 2 g of tetrahydrofuran and the resulting mixture was milled again.

Subsequently, this mill base was taken out thereof and placed in a container and tetrahydrofuran was added dropwise thereto with stirring slowly to thereby dilute till the solid content concentration in said base reached 1.6 wt. %. The thus prepared photoconductive pigment dispersion was observed to have an extremely superior dispersion stability and when it was subjected to the same sedimentation and filtering tests as in Example 1 there were obtained the same results as shown in Example 1.

This photoconductive pigment dispersion was coated onto the surface of an aluminum-evaporated polyester film by means of a doctor blade an the same was dried at 80° C. for 1 minute to thereby form a charge generation layer having a thickness of about 0.5 μm. Subsequently, a solution having the following composition was coated onto the surface of the resulting charge generation layer by means of a doctor blade and the same was dried at 100° C. for 30 minutes to thereby form a charge transport layer having a thickness of about 15 μm. Thus, a multilayered electrophotographic element was prepared.

| | |
|---|---|
| hydrazone compound 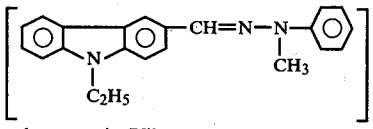 | 4 g |
| polyester resin (Vilon 200, available from TOYOBO K.K.) | 5 g |
| tetrahydrofuran | 41 g |

This electrophotographic element was measured in respect of Vpo, E1/10 and Vp30 in accordance with the same operation as in Example 1. The obtained results are as shown in Table-4.

TABLE 4

| | The first time | The tenth time |
|---|---|---|
| Vpo (volt) | 1080 | 1020 |
| E1/10 (lux.sec) | 4.2 | 4.1 |
| Vp30 (volt) | 0 | 0 |

EXAMPLE 3

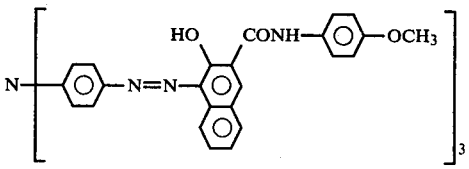

Two grams of azo pigment (photoconductive organic pigment) having a triphenylamine skeleton represented by the above mentioned structural formula were placed in a ball mill in conjunction with 12 g of toluene which is a solvent having a superior affinity to this azo pigment and 8 g of 5 wt. % toluene solution of a polystyrene resin (S-lec BLS, available from Sekisui Kagaku Kogyo K.K.) which is capable of exhibiting a superior solubility against said toluene and the resulting mixture was fully milled therein. To the same were mixed 12 g of 5 wt. % toluene solution of a polycarbonate resin (Panlite L-1225, available from TEIJIN K.K.) which is inferior in the solubility against the toluene to said polystyrene resin and 4 g of toluene and the resulting mixture was milled again.

Subsequently, this mill base was taken out thereof and placed in a container and toluene was added dropwise thereto with stirring slowly to thereby dilute till the solid content concentration in said base reached 1.6 wt. %. The thus prepared photoconductive pigment dispersion was observed to have an extremely superior dispersion stability and when it was subjected to the same sedimentation and filtering tests as in Example 1 there were obtained the same results as shown in Example 1.

This photoconductive pigment dispersion was coated onto the surface of an aluminum-evaporated polyester film by means of a doctor blade and the same was dried at 80° C. for 5 minutes to thereby form a charge generation layer having a thickness of about 0.5 μm. Subsequently, a solution having the following composition was coated onto the surface of the resulting charge generation layer by means of a doctor blade and the same was dried at 100° C. for 30 minutes to thereby form a charge transport layer having a thickness of about 15 μm. Thus, a multilayered electrophotographic element was prepared.

| | |
|---|---|
| hydrazone compound 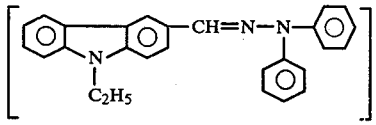 | 4 g |
| polycarbonate resin (Panlite K-1300, available from TEIJIN K.K.) | 5 g |
| tetrahydrofuran | 41 g |

This electrophotographic element was measured in respect of Vpo, E1/10 and Vp30 in accordance with the same operation as in Example 1. The obtained results are as shown in Table-5.

TABLE 5

| | The first time | The tenth time |
|---|---|---|
| Vpo (volt) | 1100 | 1060 |
| E½ (lux.sec) | 5.3 | 5.2 |
| Vp30 (volt) | 0 | 0 |

What is claimed is:

1. In an electrophotographic element comprising an electrically conductive substrate having a charge generation layer and a charge transport layer thereon, the improvement which comprises: said charge generation layer consists essentially of particles of photoconductive organic pigment dispersed in a binder consisting essentially of two different resins $R_1$ and $R_2$; said charge generation layer having been prepared by forming a dispersion of said particles of photoconductive organic pigment in a solution of resin $R_1$dissolved in a solvent S for resin $R_1$, then adding to said dispersion a solution of resin $R_2$ dissolved in a further quantity of said solvent S and mixing same to form a coating mixture, then forming said charge generation layer from said coating mixture and then evaporating said solvent S; the difference between the solubility parameters of said resin $R_1$ and said solvent S being less than about 1.0, the difference between the solubility parameters of said resin $R_1$ and said resin $R_2$ being in the range of from 0.2 to 2.2, and the difference between the solubility parameters of said resin $R_1$ and said solvent S being less than the difference between the solubility parameters of said resin $R_2$ and said solvent S.

2. An electrophotographic element as set forth in claim 1 wherein said photoconductive organic pigment particles have an average particle diameter in the range of from 0.05 μm to 0.1 μm.

3. An electrophotographic element as set forth in claim 1 wherein said photoconductive organic pigment has the formula:

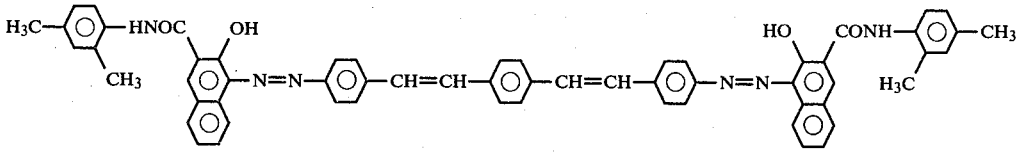

4. An electrophotographic element as set forth in claim 1 wherein said solvent is selected from the group consisting of cyclohexane, isobutylacetate, methylisobutyl ketone, isopropyl acetate, propyl butyrate, n-butyl acetate, methyl isopropyl ketone, carbon tetrachloride, cyclopentane, ethylene glycol monoethyl ether acetate, methyl propyl ketone, xylene, toluene, ethyl acetate, benzene, tetrahydrofuran, ethylene glycol methyl ethyl acetate, trichloroethylene, methyl ethyl ketone, tetrachloro ethylene, monochlorobenzene, ethylene glycol monobutyl ether, methyl acetate, 1,1,2-trichloroethane, methylene chloride, ethylene dichloride, acetone, dioxane-1,4, isobutyl alcohol, ethylene glycol monethyl ether, amyl alcohol, n-butyl alcohol, isopropyl alcohol, n-propyl alcohol, N,N-dimethyl formamide, furfuryl alcohol, ethyl alcohol, nitromethane, methyl alcohol and ethylene glycol.

5. An electrophotographic element as claimed in claim 1 wherein said solvent has a solubility parameter of from 9.1 to 9.3 and is selected from the group consisting of tetrahydrofuran, methyl ethyl ketone and ethyl acetate.

6. An electrophotographic element as claimed in claim 1 wherein said resin $R_1$ and said resin $R_2$ are selected from the group consisting of polymethyl acrylate, polyethyl acrylate, polybutyl acrylate, polypropyl acrylate, polyacrylonitrile, butadieneacrylonitrile copolymer, butadiene-styrene copolymer, dimethylsiloxane resin, epoxy resin, ethyl cellulose , polyethylene terephthalate, polymethyl methacrylate, polystyrene, polyurethane, polyvinyl acetate, polyvinyl alcohol, polyvinyl chloride, polyvinylidene chloride, vinyl chloride-vinyl acetate copolymer, nitrocellulose, cellulose acetate, polycarbonate, polyvinyl butyral resin and melamine resin.

7. An electrophotographic element as claimed in claim 1 or claim 5 wherein said resin $R_1$ is polyvinyl butyral or ethyl cellulose and said resin $R_2$ is polymethyl acrylate, cellulose acetate or polycarbonate, the difference between the solubility parameters of said resin $R_1$ and said resin $R_2$ being in the range of 0.9 to 2.2 .

8. An electrophotographic element as set forth in claim 1 wherein the difference between the solubility parameters of said resin $R_1$ and said solvent is less than about 0.8, and the difference between the solubility parameters of said resin $R_1$ and said resin $R_2$ is in the range of from 0.9 to 2.2.

9. An electrophotographic element as set forth in claim 1 wherein the amount of said binder in said charge generation layer is in the range of from 0.1 to 2 parts by weight, per one part by weight of said photoconductive organic pigment, and the weight ratio of said resin $R_1$ to said resin $R_2$ is in the range of from 0.1:1 to 1:0.1.

10. An electrophotographic element as set forth in claim 1 wherein said charge generation layer has a thickness in the range of from 0.05 to 20 μm, and said charge transport layer has a thickness in the range of from 5 to 100 μm.

11. An electrophotographic element as set forth in claim 1 wherein the amount of said binder in said charge generation layer is from 0.25 to 1.0 part by weight, per one part by weight of said photoconductive organic pigment, the weight ratio of said resin $R_1$ to said resin $R_2$ is from 0.1:1 to 1:0.1, the thickness of said charge generation layer is from 0.1 to 2 μm and the thickness of said charge transport layer is from 5 to 20 μm.

* * * * *